US011618991B2

(12) United States Patent
Shin et al.

(10) Patent No.: US 11,618,991 B2
(45) Date of Patent: Apr. 4, 2023

(54) CLOTHES CARE APPARATUS

(71) Applicant: Samsung Electronics Co., Ltd., Suwon-si (KR)

(72) Inventors: Dongwoo Shin, Suwon-si (KR); Hooijoong Kim, Suwon-si (KR); Minsung Kim, Suwon-si (KR); Jinbaek Kim, Suwon-si (KR); Hyunjoo Kim, Suwon-si (KR); Geonung Lee, Suwon-si (KR); Hwangmook Cho, Suwon-si (KR); Sung Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 271 days.

(21) Appl. No.: 16/937,003

(22) Filed: Jul. 23, 2020

(65) Prior Publication Data

US 2021/0025105 A1 Jan. 28, 2021

(30) Foreign Application Priority Data

Jul. 23, 2019 (KR) ..... 10-2019-0088921

(51) Int. Cl.
*D06F 58/10* (2006.01)
*D06F 73/02* (2006.01)
*D06F 58/20* (2006.01)

(52) U.S. Cl.
CPC ..... *D06F 58/10* (2013.01); *D06F 58/203* (2013.01); *D06F 73/02* (2013.01)

(58) Field of Classification Search
CPC ..... D06F 58/10; D06F 58/203; D06F 58/12; D06F 58/14; D06F 58/16; D06F 73/02; D06F 73/00; D06F 71/40; D06F 71/34
See application file for complete search history.

(56) References Cited

U.S. PATENT DOCUMENTS 4,592,497 A * 6/1986 Georges ..... F26B 9/003 223/69
5,555,640 A * 9/1996 Ou ..... F26B 25/066 312/249.9
6,189,346 B1 * 2/2001 Chen ..... D06F 73/02 68/5 R (Continued)

FOREIGN PATENT DOCUMENTS

FR 2687415 A1 * 8/1993
JP 3988302 10/2007

(Continued)

*Primary Examiner* — Ismael Izaguirre
(74) *Attorney, Agent, or Firm* — Staas & Halsey LLP

(57) ABSTRACT

A clothes care apparatus including: a main body including a clothes care room; a blower configured to form an airflow inside the clothes care room formed therein, and disposed between an upper part of the clothes care room and an upper part of the main body; and a duct configured to allow air inside the clothes care room to be introduced into the blower by the blower, and formed between a rear part of the main body and a rear part of the clothes care room, wherein the blower includes a blowing fan and a scroll to cover the blowing fan, and the scroll includes a flat portion formed to extend in a direction corresponding to an extension direction of the duct to guide the air into the blower.

20 Claims, 9 Drawing Sheets

(56) References Cited

U.S. PATENT DOCUMENTS

| | | | | |
|---|---|---|---|---|
| 6,427,365 | B2 * | 8/2002 | MacGregor | D06F 73/02 38/1 A |
| 2002/0133969 | A1 * | 9/2002 | Cassella | D06F 58/10 34/201 |
| 2004/0200092 | A1 * | 10/2004 | Heinz | D06F 73/02 34/376 |
| 2009/0235464 | A1 * | 9/2009 | Cassidy | D06F 17/04 68/28 |
| 2012/0317729 | A1 * | 12/2012 | Song | D06F 58/10 68/6 |
| 2016/0108576 | A1 * | 4/2016 | Levy | F26B 21/008 223/85 |

FOREIGN PATENT DOCUMENTS

| | | |
|---|---|---|
| KR | 10-1179805 | 9/2012 |
| KR | 10-2018-0070253 | 6/2018 |

* cited by examiner

CLOTHES CARE APPARATUS

CROSS-REFERENCE TO RELATED APPLICATIONS

This application is based on and claims priority under 35 U.S.C. § 119 to Korean Patent Application No. 10-2019-0088921, filed on Jul. 23, 2019, in the Korean Intellectual Property Office, the disclosure of which is incorporated herein by reference.

BACKGROUND

1. Field

The disclosure relates to a clothes care apparatus, and more specifically, to a clothes care apparatus for taking care of clothes using airflow.

2. Description of the Related Art

Generally, a clothes care apparatus refers to an apparatus that handles laundry by washing or drying the laundry. Among the clothes care apparatuses, a clothes care apparatus having a drying function may be provided with a hot air supply device to supply hot air to an accommodating space in which clothes are accommodated to dry the clothes, and may be provided with a steam generating device to perform a refresh function, such as wrinkle removal, deodorization, and static electricity removal of clothes, and the like.

The clothes care apparatus is configured in the form of a cabinet including an accommodation room for accommodating clothes. The accommodation room for accommodating clothes is formed at the upper side of the cabinet and a machine room including the steam generating device or the hot air supply device is positioned at the lower side of the cabinet. The accommodation room and the machine room may be separated from each other by a partition wall.

The clothes care apparatus may be provided with a clothes support member provided to mount clothes in the accommodation room. The clothes care apparatus may take care of clothes by translation and/or rotational movement of the clothes support member, or may take care of clothes by providing an airflow to the clothes support member.

When providing an airflow to the clothes support member to take care of clothes, the airflow may be provided by a blower, but the blower may have noise or low efficiency.

SUMMARY

Therefore, it is an object of the disclosure to provide a clothes care apparatus capable of providing a blower with enhanced efficiency and less noise.

Additional aspects of the disclosure will be set forth in part in the description which follows and, in part, will be apparent from the description, or may be learned by practice of the disclosure.

In accordance with one aspect of the disclosure, there is provided a clothes care apparatus including: a main body including a clothes care room formed therein; a blower configured to form an airflow inside the clothes care room, and disposed between an upper part of the clothes care room and an upper part of the main body; and a duct provided to allow air inside the clothes care room to be introduced into the blower by the blower, and formed between a rear part of the main body and a rear part of the clothes care room, wherein the blower includes a blowing fan and a scroll to cover the blowing fan, and the scroll includes a flat portion formed to extend in a direction corresponding to an extension direction of the duct to guide the air into the blower.

The flat portion may be disposed to face the rear part of the main body.

The scroll may include a discharge outlet formed to allow the air to be discharged by the blowing fan, and the flat portion may be disposed at a side opposite to the discharge outlet.

Air introduced into the duct may be caused to flow upward by the blower, and through the blower, the air may be discharged forward.

The duct may include a first region having a constant cross section in an upper-to-lower direction, and a second region extending upward from an upper end of the first region and having a cross section that may increase as being directed upward to reduce speed of air passing through.

The clothes care apparatus may further include an inclined portion disposed on an upper portion of the rear part of the clothes care room and obliquely formed in a front direction, and the second region may be formed between the inclined portion and the rear part of the main body.

The blowing fan may have a diameter equal to or larger than about 300% of a front-to-rear width length of the first region.

A front-to-rear distance between a rotating axis of the blowing fan and the rear surface of the clothes care room on the first region may be provided in a range of about 145% to about 160% of a front-to-rear width length of the first region.

An upper-to-lower distance between a rotating axis of the blowing fan and the upper end of the first region may be equal to or smaller than 170% of a diameter of the blowing fan.

The inclined portion may be inclined with respect to an extension direction of the first region in a range of about 45 degrees to about 90 degrees.

An outer periphery of the blowing fan may be spaced apart from the flat portion at a distance of about 10% of a diameter of the blowing fan.

The scroll may further include a suction inlet formed to allow the air to be sucked into the scroll, wherein the suction inlet may be formed to be open in a leftward direction and a rightward direction of the scroll, and the discharge outlet is formed to be open in a front side direction of the scroll.

The air introduced into the duct may be caused to flow upward by the blower, and then through the suction inlet so that the air may be introduced to a side part of the blower.

The blowing fan may include a centrifugal fan.

The blowing fan may include a Sirocco fan.

In accordance with another aspect of the disclosure, there is provided a clothes care apparatus including: a main body including a clothes care room formed therein; a blower configured to form an airflow inside the clothes care room, and disposed between an upper part of the clothes care room and an upper part of the main body; and a duct provided to allow air inside the clothes care room to be introduced into the blower by the blower, and formed between a rear part of the main body and a rear part of the clothes care room, wherein the blower may include a blowing fan and a scroll to cover the blowing fan, and the scroll includes a discharge outlet formed to allow air to be discharged forward, a flat portion arranged behind the scroll and formed to extend in a upper-to-lower direction to guide the air into the blower, and a suction inlet formed to allow air to be sucked in and arranged at a lateral side of the scroll, and air introduced into the duct may be caused to flow upward along the duct by the blower, flow into a side part of the blower through the suction inlet, and then to be discharged forward.

The flat portion may be arranged to face the rear part of the main body.

The flat portion may be formed to extend collinear with the rear part of the main body in the upper-to-lower direction.

The flat portion may be formed to extend in a direction corresponding to an extension direction of the duct.

In accordance with another aspect of the disclosure, there is provided a clothes care apparatus including: a main body including a clothes care room formed therein; a blower configured to form an airflow inside the clothes care room formed therein, and disposed between an upper part of the clothes care room and an upper part of the main body; and a duct configured to allow air inside the clothes care room to be introduced into the blower by the blower, and formed between a rear part of the main body and a rear part of the clothes care room, wherein the blower includes a blowing fan and a scroll to cover the blowing fan, and the scroll includes a flat portion formed to extend collinear with the rear part of the main body in an upper-to-lower direction to guide the air into the blower.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
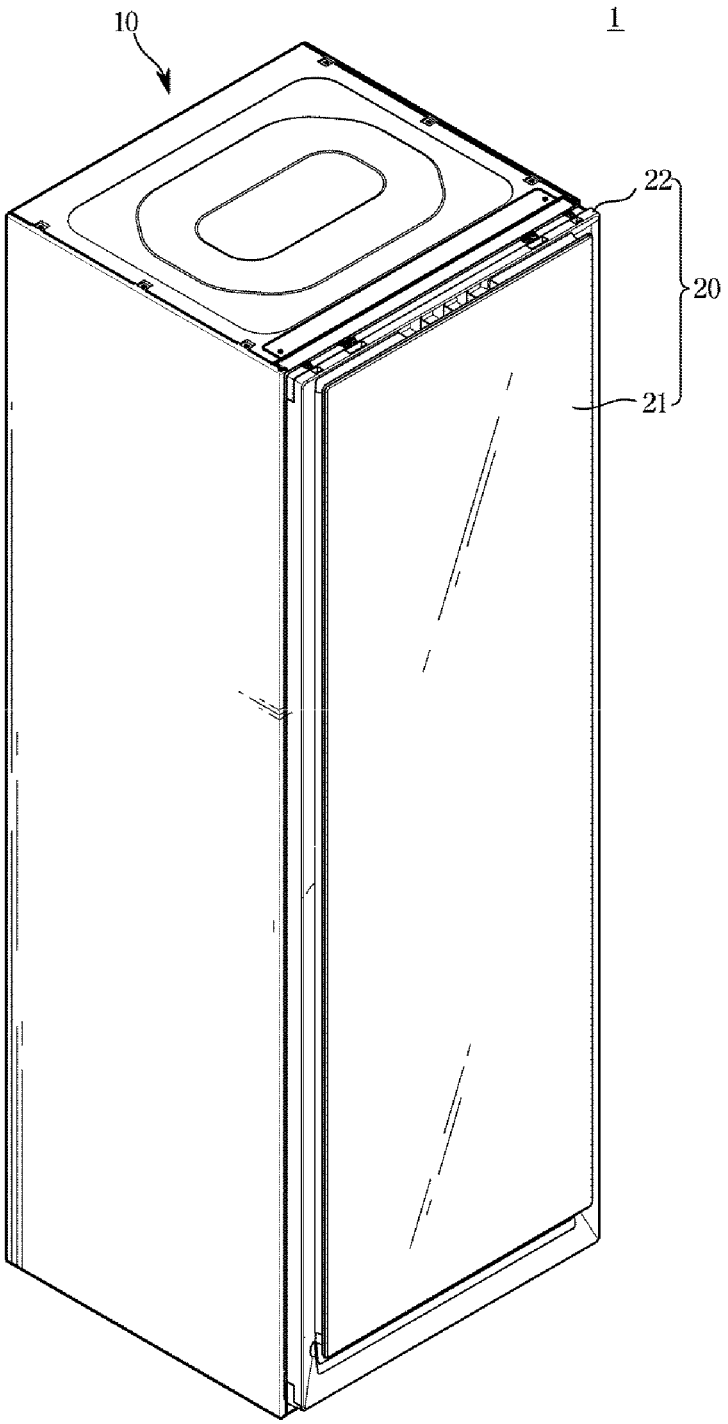
FIG. 1 is a view illustrating a clothes care apparatus according to an embodiment of the disclosure.

The embodiments set forth herein and illustrated in the configuration of the present disclosure are only the most preferred embodiments and are not representative of the full the technical spirit of the present disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Hereinafter, embodiments according to the disclosure will be described in detail with reference to the accompanying drawings.

Figure 2:
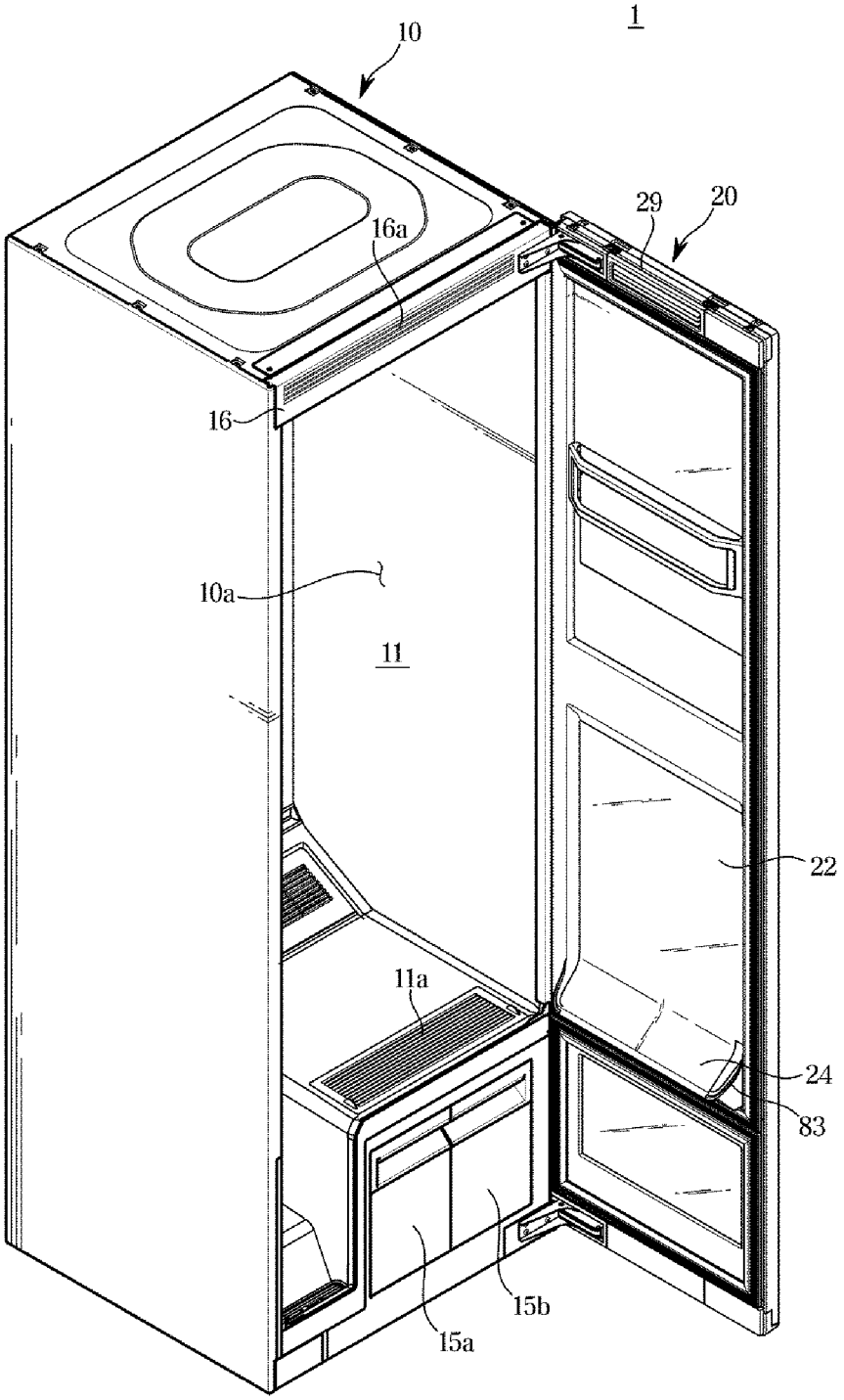
FIG. 2 is a view illustrating a state in which a door of the clothes care apparatus shown in FIG. 1 remains open.
Figure 3:
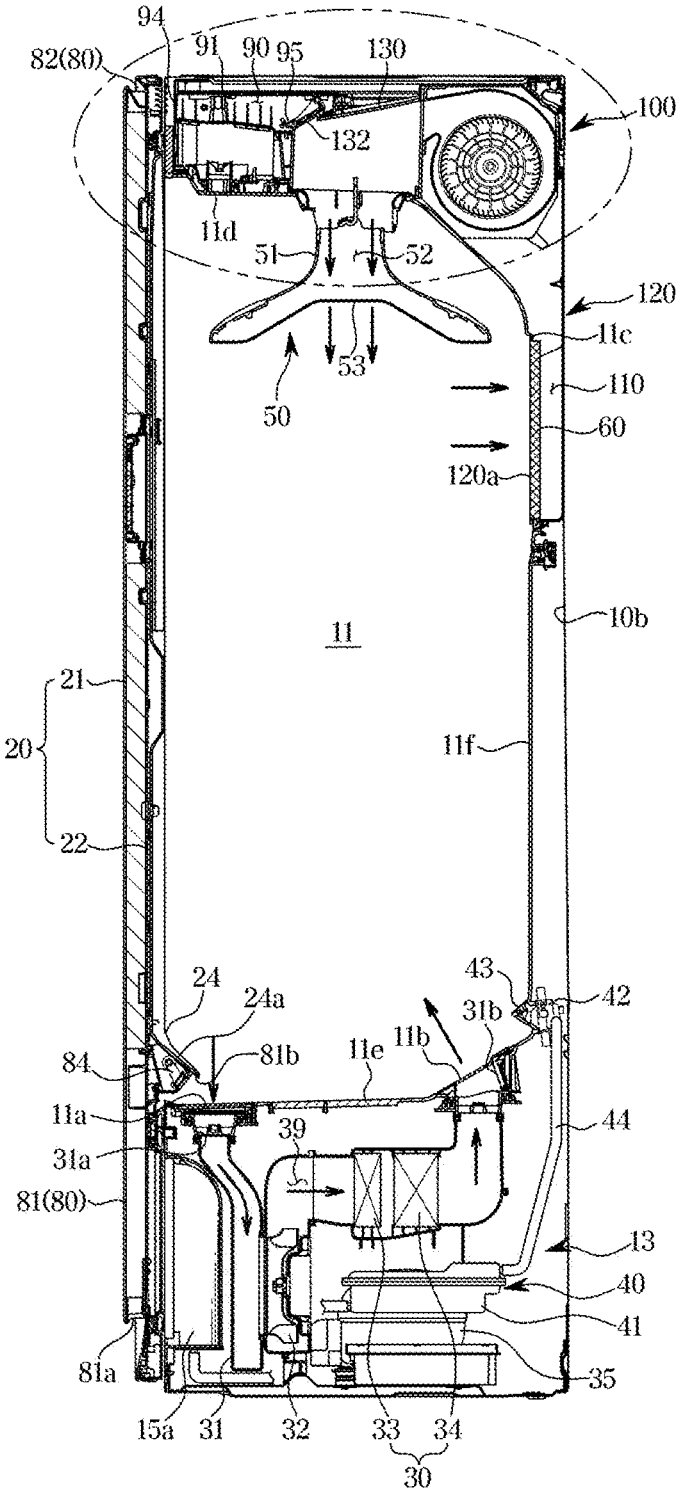
FIG. 3 is a view illustrating a side cross-section of the clothes care apparatus shown in FIG. 1.
Figure 4:
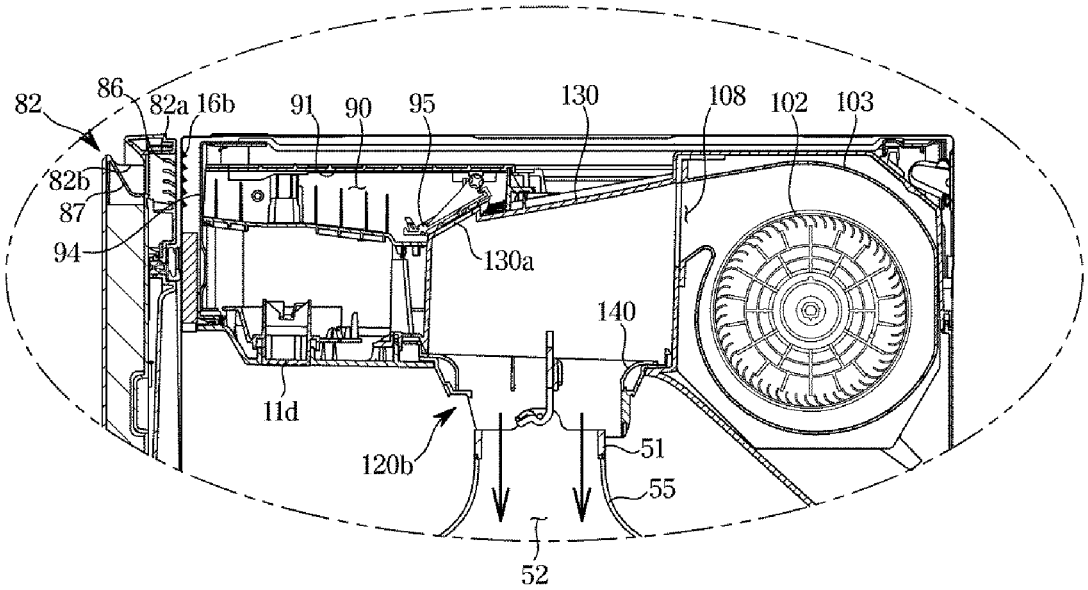
FIG. 4 is an enlarged view illustrating a part of an upper portion of the clothes care apparatus shown in FIG. 3.
Figure 5:
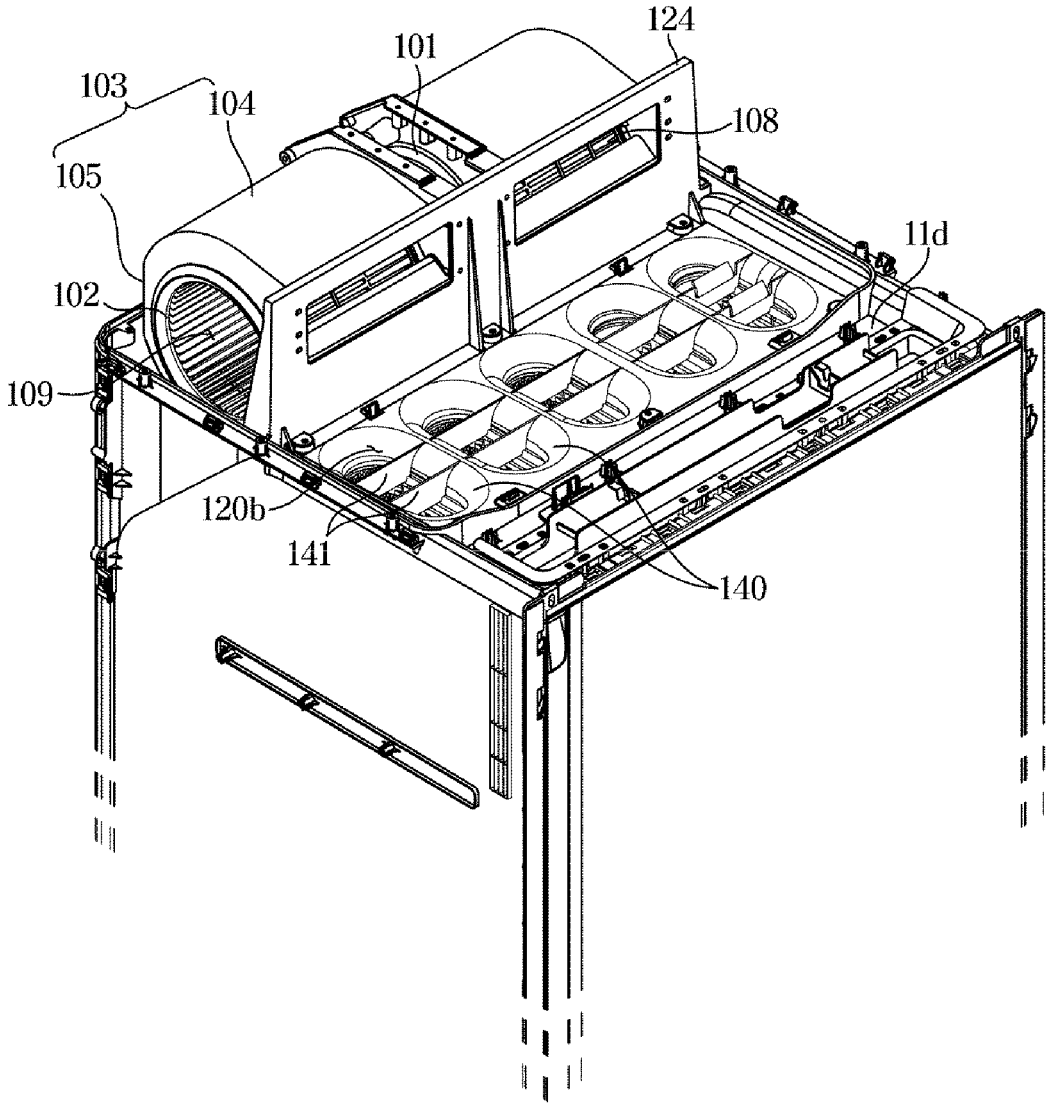
FIG. 5 is a view illustrating a guide flow path of a second circulation flow path formed inside a top cover of the clothes care apparatus shown in FIG. 1.

FIG. 1 is a view illustrating a clothes care apparatus according to an embodiment of the disclosure. FIG. 2 is a view illustrating a state in which a door of the clothes care apparatus shown in FIG. 1 remains open. FIG. 3 is a view illustrating a side cross-section of the clothes care apparatus shown in FIG. 1. FIG. 4 is an enlarged view illustrating a part of an upper portion of the clothes care apparatus shown in FIG. 3. FIG. 5 is a view illustrating a guide flow path of a second circulation flow path formed inside a top cover of the clothes care apparatus shown in FIG. 1.

Referring to FIGS. 1 to 5, the clothes care apparatus 1 may include a main body 10 forming the external appearance, a door 20 rotatably coupled to the main body 10, a clothes care room 11 provided inside the main body 10 to accommodate clothes for care, a clothes support member 50 provided inside the clothes care room 11 to mount the clothes thereon, and a machine room 13 provided with a heat exchange device 30 to dehumidify or heat air inside the clothes care room 11.

The main body 10 may be provided with the clothes care room 11 therein, and have a hexahedral shape with one surface open. An opening 10*a* may be formed on the front side of the main body 10. The main body 10 is provided with the door 20 installed at the opening 10*a* and rotatably coupled to open or close the clothes care room 11. Although not shown, the door 20 may be installed through a connecting member, such as a hinge or a link.

The clothes care room 11 forms a space in which clothes is accommodated. The clothes care room 11 may include an upper surface 11*d*, a lower surface 11*e*, a left surface, a right surface, and a rear surface 11*f* that are provided inside the main body 10. The clothes care room 1 has an opening formed at a front surface thereof. Therefore, the opening of the clothes care room 11 may be opened and closed by the door 20 that opens and closes the opening 10*a* of the main body 10.

Provided on the upper end of the opening 10*a* of the main body 10 is a discharge bracket 16 that is installed at a position corresponding to that of a discharge flow path 29 of the door 20 which will be described below. The discharge bracket 16 may include a plurality of discharge slits 16*a* arranged to correspond to the discharge flow path 29 of the door 20.

The clothes care room 11 may include a first airflow inlet 11*a*, a second airflow inlet 120*a*, a first airflow outlet 11*b*, a second airflow outlet 120*b*, and a steam outlet 43. The first airflow inlet 11*a* and the first airflow outlet 11*b* may be formed on the lower surface 11*e* of the clothes care room 11. The first airflow inlet 11*a* may be disposed on a front portion of the lower surface 11*e* of the clothes care room 11. The first airflow outlet 11*b* may be disposed on a rear portion of the lower surface 11*e* of the clothes care room 11.

The first airflow inlet 11*a* and the first airflow outlet 11*b* may be disposed at positions adjacent to each other.

The steam outlet 43 may be disposed on a lower portion of the rear surface 11*f* of the clothes care room 11. The steam outlet 43 may be disposed above the first airflow outlet 11*b*.

The second airflow inlet 120*a* may be formed on an upper portion of the rear surface 11*f* of the clothes care room 11. The second airflow outlet 120*b* may be formed on an approximately center portion of the upper surface 11*d* of the clothes care room 11. The second airflow inlet 120*a* and the second airflow outlet 120*b* may be disposed at positions adjacent to each other.

The main body 10 is provided at a lower side thereof with a drain water container 15*a* and a supply water container 15*b* that are detachably installed from the main body 10. The drain water container 15*a* and the supply water container 15*b* may be disposed at a lower side of the clothes care room 11. The drain water container 15*a* is provided to facilitate handling of condensate. The supply water container 15*b* stores water required for generating steam in a steam generating device 40, which will be described below. The water in the supply water container 15*b* is supplied to the steam generating device 40 and is used to form steam. The supply water container 15*b* may be installed to be detachable from the main body 10 to facilitate replenishment of water.

The drain water container 15*a* and the supply water container 15*b* may be provided in front of the machine room 13. The machine room 13 is provided at a lower side of the main body 10. The machine room 13 is provided below the clothes care room 11. The machine room 13 may include the heat exchange device 30 provided to dehumidify and heat the air inside the clothes care room 11 as needed.

Inside the machine room 13, a first blowing fan 32, the heat exchange device 30, and the steam generating device 40 may be arranged.

The heat exchange device 30 is installed to supply hot air into the clothes care room 11. The heat exchange device 30 is provided with an evaporator 33, a compressor 35, and a condenser 34 through which a refrigerant circulates, and is provided to dehumidify and heat air.

When the refrigerant evaporates in the evaporator 33 of the heat exchange device 30, the refrigerant absorbs latent heat of the surrounding air and condenses moisture in the air, thereby causing the moisture in the air to be removed. In addition, when the refrigerant passing through the compressor 35 is condensed in the condenser 34, the refrigerant emits the latent heat toward the ambient air, causing the surrounding air to be heated. That is, since the evaporator 33 and the condenser 34 serve as a heat exchange device, the air flowing into the machine room 13 by the first blowing fan 32 flows sequentially through the evaporator 33 and the condenser 34 to be dehumidified and heated.

The heat exchange device 30 installed in the machine room 13 includes a first duct 31 connecting the evaporator 33 and the condenser 34 to the first blowing fan 32, and the first duct 31 is provided with a first circulation flow path 39 connected to the clothes care room 11 and allowing circulation between the clothes care room 11 and the first duct 31.

The first duct 31 may be connected to the first airflow inlet 11*a* and the first airflow outlet 11*b* of the clothes care room 11. One end of the first duct 31 may be connected to the first airflow inlet 11*a* of the clothes care room 11, and the other end of the first duct 31 may be connected to the first airflow outlet 11*b* of the clothes care room 11. The first duct inlet 31*a* of the first duct 31 may be connected to the first airflow inlet 11*a*, and the first duct outlet 31*b* may be connected to the first airflow outlet 11*b*.

The air in the clothes care room 11 is introduced into the first duct 31 through the first airflow inlet 11*a*, and the introduced air is dehumidified and discharged back to the clothes care room 11 through the first airflow outlet 11*b*. In the embodiment of the disclosure, the first airflow inlet is illustrated as being disposed on the front side of the clothes care room and the first airflow outlet is illustrated as being disposed on the rear side of the clothes care room, but the concept of the disclosure is not limited thereto. For example, the positions of the airflow inlet and airflow outlet may be variously changed as needed.

The first duct 31 is provided to cause the air introduced through the first airflow inlet 11*a* to be dehumidified and discharged to the first airflow outlet 11*b*. The first blowing fan 32 is provided on the first duct 31 so that air from the clothes care room 11 is sucked into the first duct 31.

The machine room 13 may further include the steam generating device 40 for forming steam by receiving water from the supply water container 15*b*. The steam generating device 40 may be disposed in the machine room 13. The steam generating device 40 may include a steam generator 41 connected to the supply water container 15*b* to receive water and generate steam and a stem supply pipe 44 configured to guide the generated steam to a steam jetting portion 42. The steam jetting portion 42 may be disposed at a lower portion of the rear surface of the clothes care room 11.

A heater (not shown) is installed inside the steam generator 41 to heat water.

The clothes care apparatus 1 includes a dehumidifying flow path 80 provided in the door 20 to connect the clothes care room 11 and the outside during indoor dehumidification. The dehumidifying flow path 80 may be provided in the door 20. The dehumidifying flow path 80 may include at least one dehumidifying flow paths. The door 20 may include the dehumidifying flow path 80 that communicates the clothes care room 11 to the outside.

The door 20 includes a first door member 21 forming a front surface of the door 20 and a second door member 22 coupled to the first door member 21 to form a rear surface of the door 20.

The dehumidifying flow path 80 may be formed between the first door member 21 and the second door member 22. At least one of the dehumidifying flow paths 80 may be formed between the first door member 21 and the second door member 22. The dehumidifying flow path 80 may be formed on at least one of the first door member 21 and the second door member 22.

The dehumidifying flow path 80 may include an inflow path 81 for introducing outside air into the clothes care room 11 and an outflow path for discharging air inside the clothes care room 11 to the outside 82 that are provided in the door 20.

The first door member 21 is formed in a plate shape. The first door member 21 may include a mirror, glass, panel, or the like. In the embodiment of the disclosure, the first door member 21 is illustrated as a plate-shaped mirror, but the concept of the disclosure is not limited thereto. For example, the first door member may include a cover formed of various materials that are combined to have a sense of unity with furniture or the like indoors where the clothes care apparatus 1 is installed.

The first door member 21 may be installed in front of the second door member 22 to form the external appearance of the clothes care apparatus 1.

The inflow path 81 is provided to allow air introduced through a first inlet 81*a* to be moved and discharged to the clothes care room 11 through a first outlet 81*b*.

The inflow path 81 may include an inflow path duct 83 that guides the air introduced through the first inlet 81*a* to move. The first outlet 81*b* may be formed in the inflow path duct 83.

The inflow path 81 may include a first damper device 84 provided to open or close the first outlet 81*b*. The first damper device 84 may be provided inside the inflow path duct 83. The inflow path duct 83 includes the first damper device 84 provided to open or close the first outlet 81*b*.

The door 20 includes a condensate guide 24 to guide movement of condensate. The condensate guide 24 is provided to guide the condensate formed by condensation on the rear surface of the door 20. The condensate guide 24 may include a curved portion 24*a* formed from the rear surface of the second door 22 to be slanted toward the clothes care room 11.

The curved portion 24*a* of the condensate guide 24 may include at least one surface of the inflow path duct 83. The curved portion 24*a* of the condensate guide 24 may form an upper surface of the inflow path duct 83.

The discharge flow path 82 is provided to allow air introduced through the second inlet 82*a* to be moved and discharged to the outside of the clothes care room 11 through the second outlet 82*b*. The discharge flow path 82 is provided on the door 20 to discharge the air inside the clothes care room 11 to the outside.

The main body 10 further includes a connecting flow path 90 connecting a second circulation flow path 120 to the discharge flow path 82 so as to transfer the internal air of the clothes care room 11 to the discharge flow path 82.

The connecting flow path 90 may be provided on a top cover 130 provided on the upper side of the clothes care room 11. The connecting flow path 90 may be formed in connection with the second circulation flow path 120. The connecting flow path 90 may be formed by branching from the second circulation flow path 120.

The connecting flow path 90 may include a connecting duct 91. The connecting flow path 90 may be formed inside the connecting duct 91. The connecting duct 91 may be coupled to the top cover 130. The connecting flow path 90 may be formed by connecting the connecting duct 91 to the top cover 130. The top cover 130 includes a connecting flow path hole 132. The connecting flow path hole 132 may be formed on a front portion of the top cover 130. The connecting duct 91 is formed to be connected to the connecting flow path hole 132 of the top cover 130.

A connecting duct outlet 94 connected to the opening 10*a* of the main body 10 is formed on a front surface of the connecting duct 91. The connecting duct outlet 94 is formed on the front surface of the connecting duct 91 such that air of the second circulation flow path 120 flowing through the connecting flow path hole 132 flows into the connecting flow path 90 and moves toward the opening 10*a* of the main body 10 through the connecting duct outlet 94.

A second damper device 95 is provided inside the connecting duct 91 so as to open or close a space with the second circulation flow path 120. The second damper device 95 is formed to open or close the connecting flow path hole 132 of the top cover 130.

The connecting duct outlet 94 of the connecting duct 91 may be formed to correspond to the dehumidification flow path 80 formed in the door 20. The connecting duct outlet 94 may be formed to correspond to the discharge flow path 82 of the door 20. The connecting duct outlet 94 may be formed at a position corresponding to that of the second inlet 82*a* of the discharge flow path 82. The connecting duct outlet 94 may be arranged to be connected to the second inlet 82*a* of the discharge flow path 82.

The discharge flow path 82 includes the second inlet 82*a*, and the second outlet 82*b* formed such that air of the clothes care room 11 introduced through the second inlet 82*a* is discharged to the outside of the main body 10 and the door 20.

The second inlet 82*a* is provided on the second door member 22 of the door 20. The second inlet 82*a* is provided on the upper portion of the second door member 22. The second inlet 82*a* is formed on the rear surface of the second door member 22. The second inlet 82*a* is formed at a position corresponding to that of the connecting duct outlet 94 of the connecting duct 91. Air inside the second circulation flow path 120*s* introduced through the second inlet 82*a*, that is, air inside the clothes care room 11 is discharged to the second outlet 82*b*. The second outlet 82*b* is provided on the upper portion of the door 20. The second outlet 82*b* is formed on the upper portion of the second door member 22. The second inlet 82*a* and the second outlet 82*b* are formed in communication with each other. The air in the clothes care room 11 flowing through the second circulation flow path 120 may be discharged to the outside of the main body 10 through the door 20 through the connecting flow path 90 during dehumidification of the clothes care room 11.

The discharge flow path 82 formed between the second inlet 82*a* and the second outlet 82*b* may include a discharge guide 86 that guides air to be discharged to the second outlet 82*b*. The discharge guide 86 may include at least one discharge guide 86. The discharge guide 86 is formed to guide air introduced through the second inlet 82*a* toward the second outlet 82*b*. The discharge flow path 82 may further include a discharge flow path guide 87 formed on the second door member 22. The discharge flow path guide 87 may be formed on an upper end of the second door member 22. Air flowing into the discharge flow path 82 through the second inlet 82*a* is guided by the discharge flow path guide 87 and discharged to the outside of the door 20.

In the dehumidifying operation of the clothes care apparatus 1 according to the embodiment of the disclosure, the dehumidifying flow path 80 provided in the door 20 allows the clothes care room 11 of the main body 10 to communicate with the indoor space.

The clothes care room 11 is provided therein with the clothes support member 50 which is provided such that clothes are mounted and supported. The clothes support member 50 may be installed on the upper surface 11*d* of the clothes care room 11. The clothes support member 50 may be detachably installed in the clothes care room 11. The clothes support member 50 may include at least one clothes support member.

The clothes care room 11 may include a blowing device 100 that causes air to flow therein.

The clothes care room 11 may include a second duct 110, and the second duct 110 may provide air inside the clothes care room 11 to the blowing device 100. The second duct 110 may be provided in communication with the clothes care room 11 to form at least a portion of the second circulation flow path 120 that allows circulation between the clothes care room 11 and the second duct 110. The blowing device 100 may be disposed on the second circulation flow path 120.

The second duct 110 may be formed behind the second airflow inlet 120*a* of the clothes care room 11. The second duct 110 is provided on the upper portion of the rear surface of the clothes care room 11 and may include a filter member 60 therein.

The air introduced into the second duct 110 may flow to the top cover 130 disposed on the upper side of the clothes care room 11 through the blowing device 100. The blowing device 100 may be installed between the second duct 110 and the top cover 130.

The blowing device 100 is disposed at the upper rear side of the clothes care room 11, and may include a blowing motor 101 that generates rotational force and at least one second blowing fan 102 that rotates by the blowing motor 101. The second blowing fan 102 may be accommodated by a scroll 103.

The scroll 103 may be coupled to a duct bracket 124 provided on the upper surface 11*d* of the clothes care room 11. The duct bracket 124 is formed with at least one opening that communicates with an outlet 108 formed in the scroll 103, and as the outlet 108 is disposed to correspond to the at least one opening, air introduced into the second duct 110 is caused to move to the second airflow outlet 120*b*.

The second duct 110 may connect the second airflow inlet 120*a* to the second airflow outlet 120*b* of the clothes care room 11. The inlet of the second duct 110 is integrally formed with the second airflow inlet 120*a* of the clothes care room 11 described above, and the inlet of the second duct 110 and the second airflow inlet 120*a* may be considered the same configuration.

That is, one end of the second circulation flow path 120 is formed by the second air flow inlet 120*a*, and the other end of the second circulation flow path 120 is formed by the second air flow outlet 120*b*, and the second circulation flow path 120 may be formed by the second duct 110 and the blowing device 100 and the top cover 130.

One end of the second duct 110 is formed by the second airflow inlet 120*a* described above, and the other end of the second duct 110 may be provided to provide air to the blowing device 100.

The second airflow outlet 120*b* communicates with the clothes support member 50 so that a part of air introduced from the second duct 110 is transferred to the clothes support member 50.

The clothes support member 50 may be installed on the upper surface 11*d* of the clothes care room 11. The clothes support member 50 may be formed in the form of a hanger so that clothes may be inserted around the clothes support member 50.

The clothes support member 50 is provided to allow air to flow therein.

The clothes support member 50 is formed in a clothes hanger shape having a substantially triangular shape. The clothes support member 50 includes a body 55 in which a flow path 52 is formed so that air introduced through the second airflow outlet 120*b* flows therein. An air supply port 51 may be formed at an upper end of the body 55. An air discharge port 53 may be formed at a lower end of the body 55.

Dust or foreign substances on the clothes may be removed by air supplied into the clothes support member 50.

In the embodiment of the disclosure, the air supply port is formed on the upper end of the clothes support member, and air supplied through the air supply port is supplied to the inside and outside of the clothes, but the concept of the disclosure is not limited thereto. For example, the air supply port may be formed in various sizes at various locations so that the supplied air may be widely sprayed onto the clothes. In addition, the clothes support member 50 may be provided in various shapes beside a hanger shape.

The blowing device 100 disposed to be connected to the second duct 110 is provided to suck in the air inside the clothes care room 11 through the second airflow inlet 120*a* and discharge the sucked air to the second airflow outlet 120*b*.

The filter member 60 is provided at the second airflow inlet 120*a* of the clothes care room 11. The second airflow inlet 120*a* is formed on the rear surface 11*f* of the clothes care room 11. A filter member installation portion 11*c* for installing the filter member 60 is provided on the rear surface 11*f* of the clothes care room 11. The second airflow inlet 120*a* may be formed at a position corresponding to that of the filter member installation portion 11*c*.

The inside air of the clothes care room 11 may be filtered by the filter member 60 of the second airflow inlet 120*a* when flowing into the second duct 110. The air introduced into the second duct 110 may have dust and odor removed by the filter member 60. The air filtered by the filter member 60 may be discharged to the second airflow outlet 120*b* and the clothes support member 50 through the blowing device 100.

The filter member 60 may include a dust collecting filter (not shown) for removing dust or a device for deodorization.

Therefore, for the clothes care, the clothes care room 11 operates while clothes is mounted on the clothes support member 50 and the door 20 remains closed. In this case, the clothes care room 11 may have air circulated along the first circulation flow path 39 and the second circulation flow path 120.

The air that has passed through the blowing device 100 may move to the guide flow path 130*a* formed inside the top cover 130. The guide flow path 130*a* is a part of the second circulation flow path 120. The guide flow path 130*a* may be formed by the top cover 130 and the upper surface 11*d* of the main body 10.

The clothes care apparatus 1 may include a nozzle 140 that guides the air introduced into the guide flow path 130*a* to the clothes mounted on the clothes support member 50. The nozzle 140 may be disposed on the upper surface 11*d* of the main body 10. The nozzle 140 may form the second airflow outlet 120*b*.

The nozzle 140 may be provided in plural. The nozzles 140 may be arranged in a second direction Y perpendicular to a first direction X in which the clothes care room 11 is opened. However, the disclosure is not limited thereto, and the nozzle 140 may be arranged in the first direction X.

According to the embodiment of the disclosure, the nozzle 140 includes five nozzles, but the disclosure is not limited thereto, and the nozzle 140 may be provided in two to four nozzles or in at least five nozzles. In addition, although the second blowing fan 102 is illustrated as being provided in two units thereof, the number of the second blowing fans 102 is not limited thereto, and may be provided in one unit or at least three units thereof. Since the five nozzles 140 have the same configuration, the following description will be made on one nozzle 140 below.

The nozzle 140 may guide the air of the guide flow path 130*a* to the clothes care room 11. The nozzle 140 may guide the air discharged from the blowing device to the inside and outside of the clothes mounted on the clothes support member 50 in cooperation with the top cover 130.

Specifically, an upper end of the nozzle 140 communicates with the guide flow path 130*a*, and the second air outlet 120*b* may be formed at a lower end of the nozzle 140. That is, the second airflow outlet 120*b* may be formed by the lower end of the nozzle 140.

The second airflow outlet 120*b* through which the air guided by the nozzle 140 is discharged may be formed to be larger than the air supply port 51 of the clothes support member 50. The second airflow outlet 120*b* may allow a part of the air discharged through the second airflow outlet 120*b* to be discharged to the inside of the clothes support member 50 through the air supply port 51, and allows a remaining part of the air to be discharged to the outside of the air supply port 51 to thereby be discharged to the outside of the clothes support member 50. The second airflow outlet 120*b* may be formed to have a diameter larger than that of the air supply port 51. A part of the air passing through the nozzle 140 may be discharged to the outer surface of the clothes support member 50 through a gap between the second airflow outlet 120*b* and the air supply port 51.

The nozzle 140 may include a blade 141 for guiding air. The blade 141 may be provided in plural to guide the direction of air, and although not shown in the drawings, may be provided to be tilted in connection with a driving member.

Hereinafter, the blowing device 100 and the second duct 110 according to the embodiment of the disclosure will be described in detail.

Figure 6:
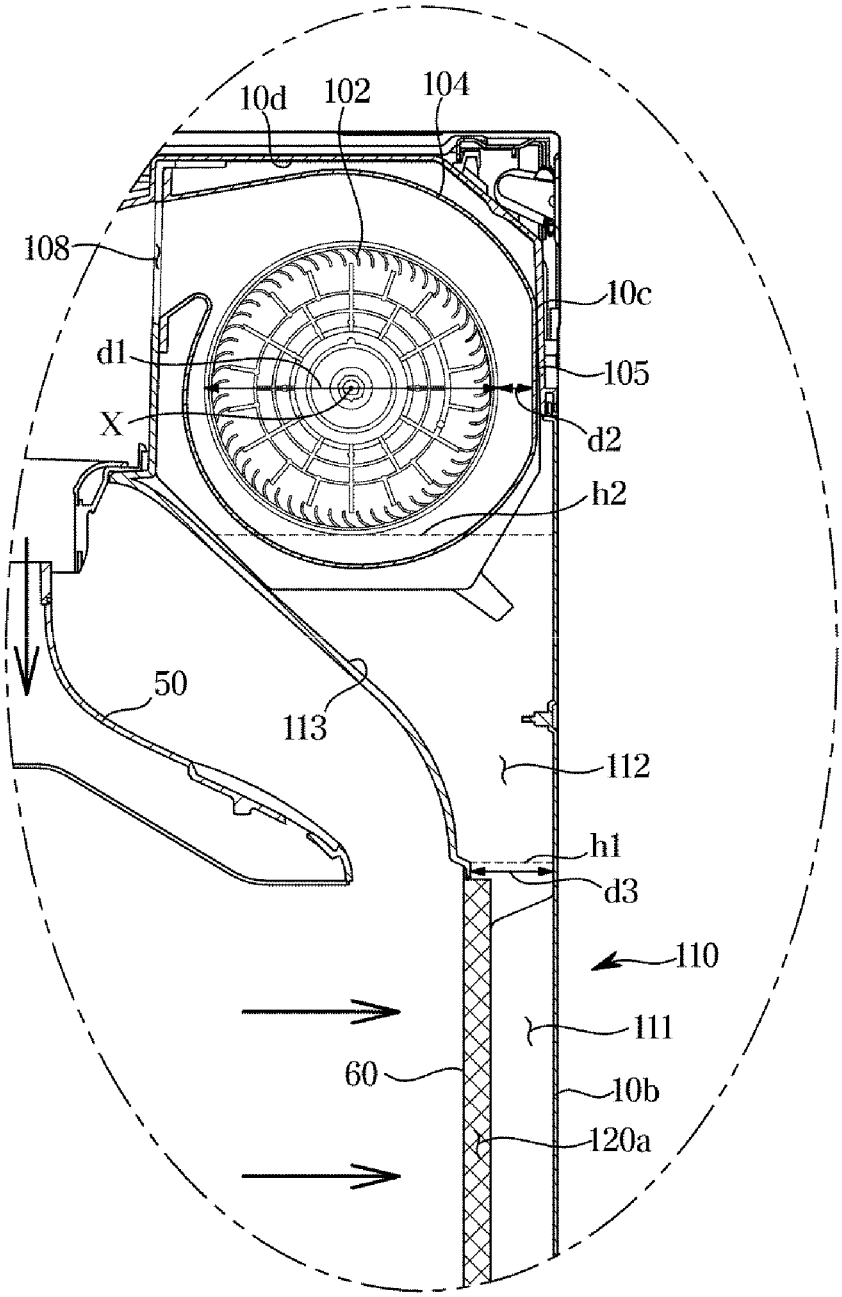
FIG. 6 is an enlarged view illustrating a part of a rear surface of the clothes care apparatus shown in FIG. 3.
Figure 7:
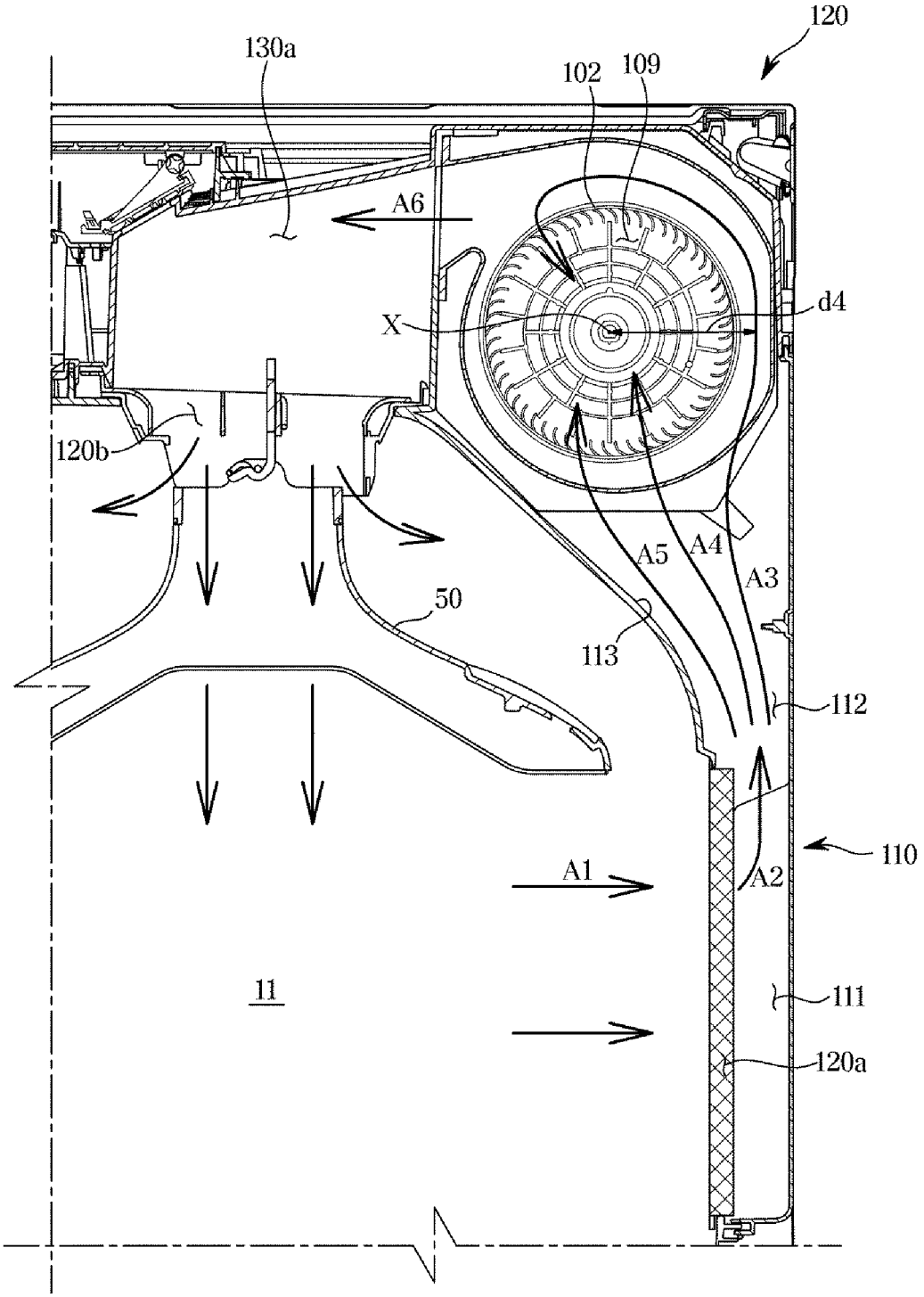
FIG. 7 is a view illustrating a state in which air is circulated in the second circulation flow path of the clothes care apparatus according to the embodiment of the disclosure.
Figure 8:
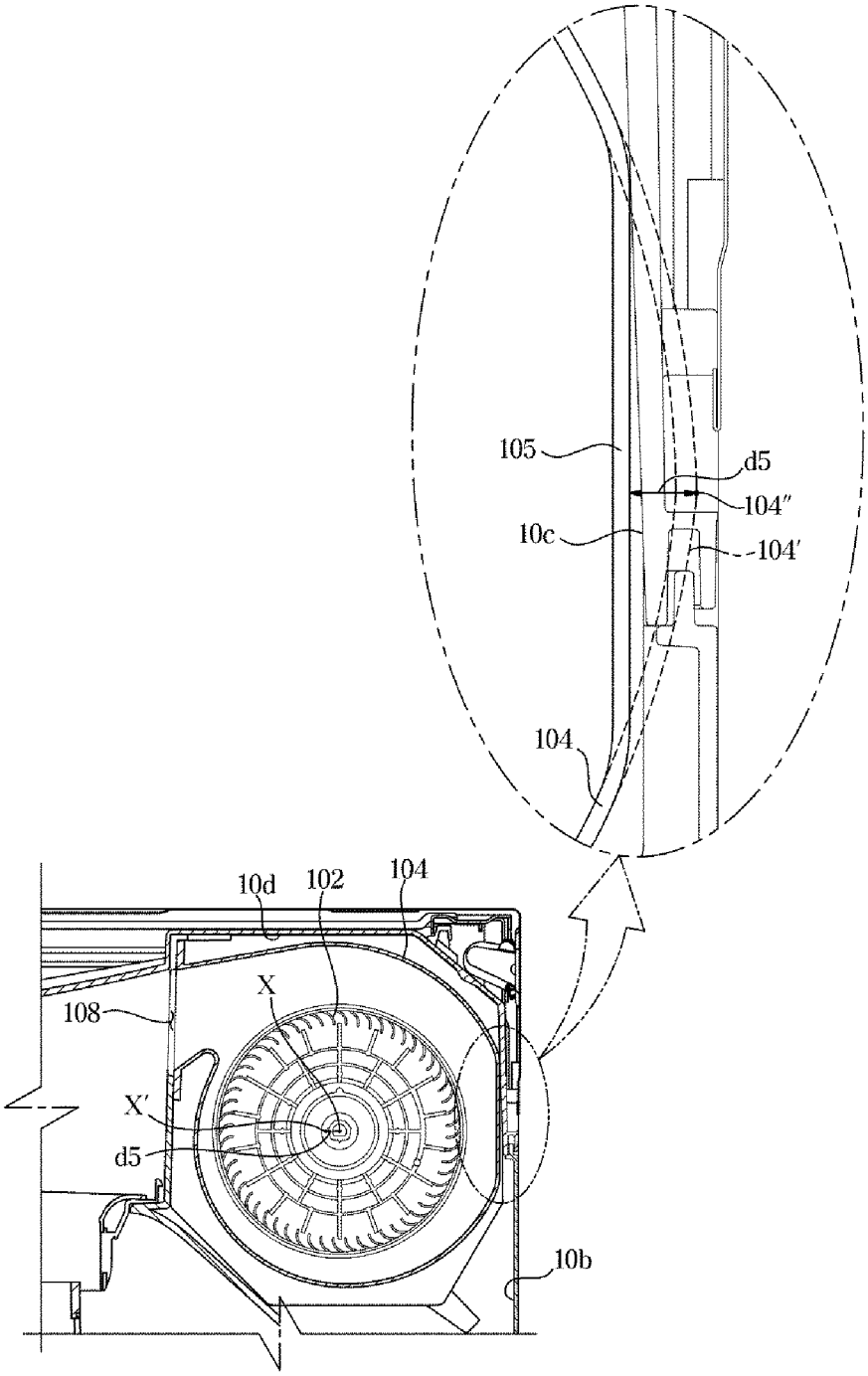
FIG. 8 is an enlarged view illustrating a part of a rear surface of the clothes care apparatus shown in FIG. 6.
Figure 9:
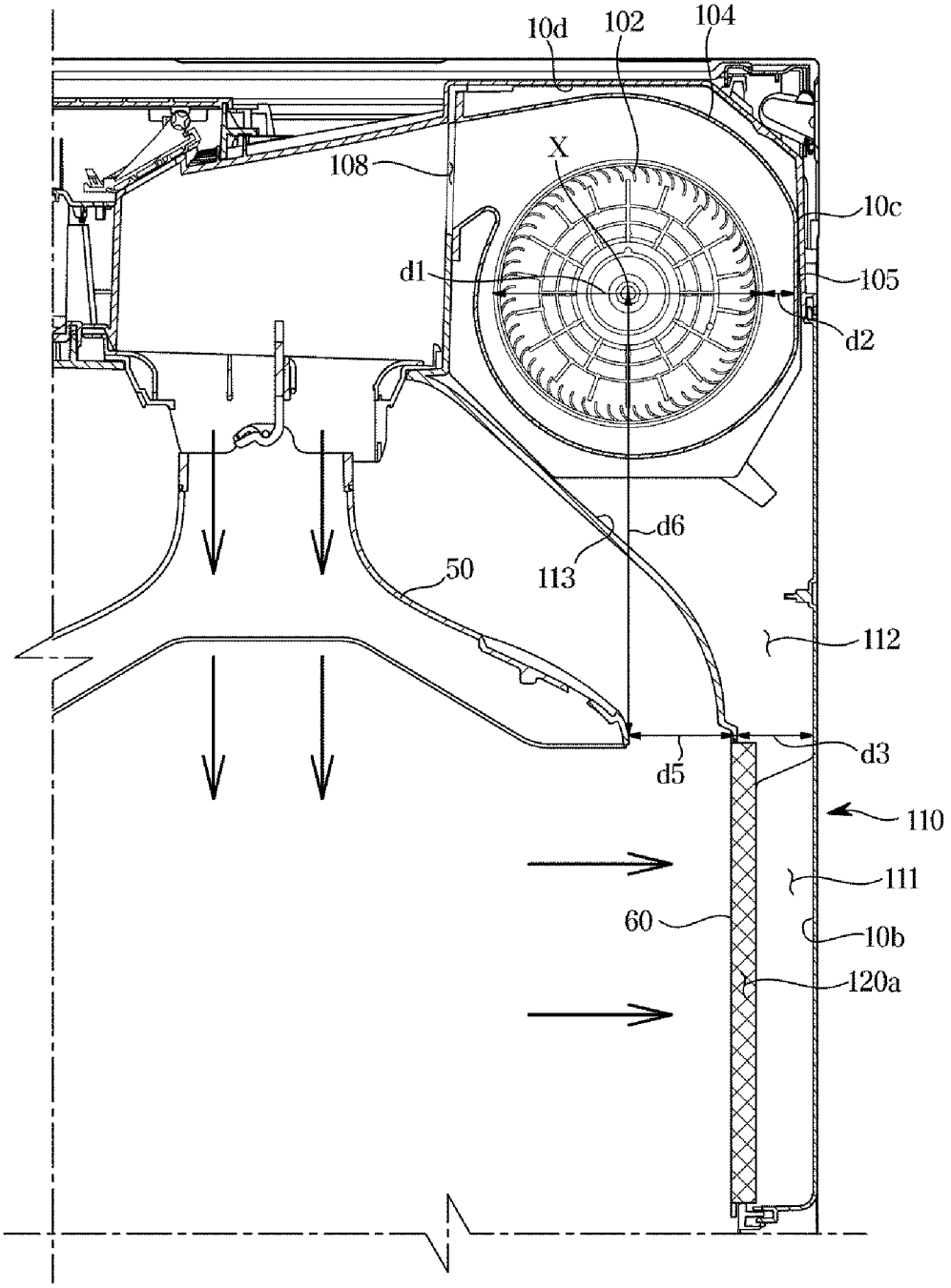
FIG. 9 is an enlarged view illustrating a part of a rear surface of the clothes care apparatus shown in FIG. 3.

FIG. 6 is an enlarged view illustrating a part of a rear surface of the clothes care apparatus shown in FIG. 3. FIG. 7 is a view illustrating a state in which air is circulated in the second circulation flow path of the clothes care apparatus according to the embodiment of the disclosure. FIG. 8 is an enlarged view illustrating a part of a rear surface of the clothes care apparatus shown in FIG. 6. FIG. 9 is an enlarged view illustrating a part of a rear surface of the clothes care apparatus shown in FIG. 3.

As described above, the second duct 110 and the blowing device 100 may form the second circulation flow path 120.

As shown in FIG. 6, the blowing device 100 may be disposed between the upper surface 11*d* of the clothes care room 11 and the upper surface 10*d* of the main body 10. In detail, the blowing device 100 is disposed between an edge formed by the upper surface 11*d* and the rear surface 11*f* of the clothes care room 11 and an edge formed by the upper surface 10*d* and the rear surface 10*b* of the main body 10.

The second duct 110 is provided to supply air to the blowing device 100, and may be disposed between the rear surface 10*b* of the main body 10 and the rear surface 11*f* of the clothes care room 11.

The front surface of the second duct 110 is formed by the rear surface 11*f* of the clothes care room 11, and the rear surface of the second duct 110 is formed by the rear surface 10*b* of the main body 10, but the disclosure is not limited thereto. For example, an additional member may be disposed between the rear surface 10*b* of the main body 10 and the rear surface 11*f* of the clothes care room 11 to form the second duct 110.

The second duct 110 may be provided to extend in the vertical direction from the second airflow inlet 120*a*, which is the inlet of the second duct 110, to the suction inlet 109 of the blowing device 100.

The second duct 110 may include a first region 111 extending in the vertical direction while having a constant width d3 or a constant cross section in the horizontal direction.

The second duct 110 may include a second region 112 that has a width or cross-section increasing as being directed upward from an upper end h1 of the first region 111, and extends to a lower end h2 of the suction inlet 109.

The upper end h1 of the first region 111 may be defined as the uppermost end of a region where the width d3 of the second duct 110 is maintained constant, and the lower end h2 of the suction inlet 109 may be defined as a tangent at the front-to-rear direction lowermost end of the suction inlet 109.

The rear surface 11*f* of the clothes care room 11 may include an inclined portion 113 disposed on the upper portion of the rear surface 11*f* and sloping forward as being directed upward.

The inclined portion 113 allows the second region 112 to increase in width or cross-section of the second duct 110 as being directed upward.

As described above, the blowing device 100 may include the second blowing fan 102 and the scroll 103 provided to cover the second blowing fan 102. The blowing device 100 may include the suction inlet 109 formed at a side surface of the scroll 103 and provided to suck in air into the second blowing fan 102 (see FIG. 5).

The suction inlet 109 may be provided in a circular shape formed around a rotation axis X of the second blowing fan 102.

The blowing device 100 may include the discharge outlet 108 disposed on the front surface of the scroll 103 and through which air is discharged by the second blowing fan 102.

The air introduced through the suction inlet 109 is discharged through the second blowing fan 102 to the discharge outlet 108 along the inside of the scroll 103, and flows to the guide flow path 130*a*, after which the air may flow through the second airflow outlet 120*b* to the clothes support member 50 or the clothes care room 11.

The second blowing fan 102 may be provided as a centrifugal fan. In detail, the second blowing fan 102 may be provided as a sirocco fan. Accordingly, the second blowing fan 102 may allow air sucked from the suction inlet 109 formed on the side surface of the scroll 103 to be discharged to the discharge outlet 108 formed on the front surface of the scroll 103.

The scroll 103 may include a substantially cylindrical shape based on the rotation axis X of the second blowing fan 102. Accordingly, the air flowing inside the scroll 103 is caused to flow along approximately inner circumferential surface of the cylinder to the discharge outlet 108, and in this case, the air may flow to the discharge outlet 108 with a minimum resistance in the flow direction.

The scroll 103 may include a curved portion 104 to form the cylindrical shape thereof.

The curved portion 104 is formed to have a width between the outer periphery of the second blowing fan 102 and the scroll 103 that increases as being rotationally directed from the rotation axis X of the second blowing fan 102 to the discharge outlet 108.

The scroll 103 may include a flat portion 105 obtained by at least a portion of the curved portion 104 that is formed to be flat.

The flat portion 105 may include a planar surface having a straight line corresponding to the upper-to-lower direction in which the second duct 110 extends on the curved portion 104. The flat portion 105 is formed in at least one area of the curved portion 104, and the at least one area is an area provided on the rear side opposite to the front surface of the scroll 103 in which the discharge outlet 108 is disposed.

That is, the flat portion 105 is an area formed on the rear surface of the scroll 103 and including a planar surface extending in the upper-to-lower direction on the curved portion 104.

The flat portion 105 may be formed to face the rear surface 10*b* of the main body 10. In detail, the flat portion 105 of the rear surface 10*b* of the main body 10 is disposed to face a contact portion 10*c* that is formed to make contact with the flat portion 105. Details thereof will be described below in detail.

As illustrated in FIG. 7, when air inside the clothes care room 11 flows into the second duct 110 (A1), the air may flow upward through the second airflow inlet 120*a* in the first region 111.

The first region 111 is disposed between the rear surface 11*f* of the clothes care room 11 and the rear surface 10*b* of the main body 10 as described above. In general, the second duct 110 in the first region 111 may have a width d3 that is narrow enough to increase the capacity of the clothes care room 11.

Air A2 flowing in a space of the narrow width d3 on the first region 111 may be caused to flow upward at a high speed and reach the second region 112. As described above, since the second region 112 has a width gradually increasing as being directed upward due to the inclined portion 123, the air A2 from the first region 111 may provide air A4 and A5 with lowered speeds in the cause of passing through the second region 112.

The air A4 and A5 whose speed is reduced as described above may flow directly to the suction inlet 109 along the second region 112. That is, the air A4 and A5 with reduced speed that passes through the second region 112 may be easily sucked into the blowing device 100 through the suction inlet 109 along a suction airflow formed by the second blowing fan 102. The sucked air into the blowing device 100 is then discharged from the blowing device 100 (air A6).

However, some air A3 flowing through the second region 112 may not flow to the suction inlet 109 without being affected by the suction airflow formed by the second blowing fan 102, but may reach the upper surface 10*d* according to the travelling direction to collide with the upper surface 10*d*, and then flow to the suction inlet 109.

In other words, the air A3 that is a part of a high-speed airflow formed while passing through the first region 111 may flow in the traveling direction with a force greater than that of the suction airflow formed by the second blowing fan 102, and thus may not flow in the direction of the suction inlet 109.

As the air A3, after flowing between the main body 10 and the clothes care room 11, sucked into the suction inlet 109 rather than being directly sucked into the suction inlet 109 on the second region 112 increases, more noise occurs due to collision between the air A3 and the main body 10 or the clothes care room 11. In addition, when the output of the second blowing fan 102 is increased to form a stronger suction airflow such that the air A3 is directly sucked into the second blowing fan 102, additional noise with the second blowing fan 102 may occur.

In addition, since the air A3 flowing in the second region 112 is not directly sucked into the blowing device 100 through the suction inlet 109, suction of certain air may delayed, which leads to deterioration of the efficiency of the blowing device 100.

The airflow A3 not directly sucked into the second blowing fan 102 is caused to flow at a predetermined distance d4 or more away from the second blowing fan 102, without being affected by the suction airflow formed by the second blowing fan 102.

That is, the airflow A3 flowing at a predetermined distance d4 away from the second blowing fan 102 is an airflow of air flowing in the second region 112 that is not affected by the suction airflow formed by the second blowing fan 102 as being distant away from the second blowing fan 102 and thus is not directly caused to flow to the suction inlet 109.

As described above, since the second duct 110 is disposed between the rear surface 10*b* of the main body 10 and the rear surface 11*f* of the clothes care room 11, at least a part of air flowing through the second duct 110 may flow upward along the rear surface 10*b* of the main body 10.

In this case, a constant spacing distance is formed between the rear surface 10*b* of the main body 10 and the second blowing fan 102, and an influence of the suction airflow of the second blowing fan 102 may not reach the spacing distance. Accordingly, the airflow A3 flowing at a predetermined distance d4 may not flow toward the suction inlet 109 but may flow upward.

Here, the predetermined distance d4 may be defined as a perpendicular distance to an airflow flowing in the upper-to-lower direction from the rotational axis X of the second blowing fan 102.

The air flowing at a distance greater than the predetermined distance d4 is not affected by the suction airflow formed by the second blowing fan 102 and thus does not flow toward the suction inlet 109.

In this case, when the amount of the airflow A3 in air flowing through the second region 112 that is not affected by the suction airflow decreases, less noise occurs and the efficiency of the blowing device 100 may be increased because air flowing in the second region 112 is easily sucked even when the second blowing fan 102 consumes a small power.

To this end, when the rotational axis X of the second blowing fan 102 is disposed further adjacent to the rear surface 10*b* of the main body 10, the amount of the airflow affected by the suction airflow formed by the second blowing fan 102 may be increased.

This is because when the range of influence of the suction airflow formed by the second blowing fan 102 is broaden in the direction toward the rear surface 10*b* of the main body 10 by a distance the second blowing fan 102 moved in the direction toward the rear surface 10*b* of the main body 10, the amount of the airflow flowing at a distance larger than the predetermined distance d4 decreases.

Therefore, the clothes care apparatus according to the embodiment of the disclosure arranges the second blowing fan 102 as close as possible to the rear surface 10*b* of the main body 10 through the flat portion 105 of the scroll 103, so that the position of the rotational axis X of the second blowing fan 102 is arranged as close as possible to the rear surface 10*b* of the main body 10.

Accordingly, the amount of air passing through the second region 112 that is affected by the suction airflow formed by the second blowing fan 102 increases, and thus the amount of air flowing from the second duct 110 that is directly introduced into the suction inlet 109 increases, so that noise decreases and the efficiency of the blowing device 100 may be enhanced.

As shown in FIG. 8, the flat portion 105 may be disposed to face the rear surface 10*b* of the main body 10. Alternatively, the flat portion 105 may be disposed in contact with the rear surface 10*b* of the main body 10. In detail, from the perspective of the rear surface 10*b* of the main body 10, the flat portion 105 may be disposed to come into contact with the contact surface 10*c* that faces the flat portion 105.

The flat portion 105 may be partially contacted with the contact surface 10*c*, and the disclosure is not limited thereto, and thus the entire flat portion 105 may be disposed in contact with the contact surface 10*c*.

Accordingly, the flat portion 105 may be disposed approximately in line with the contact surface 10*c* or the rear surface 10*b* of the main body 10 in the upper-to-lower direction.

In addition, the disclosure is not limited thereto, and the flat portion 105 may be disposed collinear with the contact surface 10*c* or the rear surface 10*b* of the main body 10. Such a configuration may be implemented by a method in which the rear surface 10*b* and the flat portion 105 are integrally formed with each other, or the flat portion 105 is inserted up to a position vertically in line with the rear surface 10*b* of the main body 10.

That is, when the flat portion 105 is not arranged on the scroll 103 as in the related art, the rear surface of the scroll 103 may be formed as a part 104' of a virtual curved portion 104. The part 104' of the virtual curved portion 104 may include a curve and may include a virtual rearmost end 104".

In this case, when the rear surface 10*b* of the main body 10 and the rearmost end 104" of the scroll 103 come into contact with each other, the second blowing fan 102 is caused to be disposed while being spaced apart from the rear surface 10*b* of the main body 10 by a perpendicular distance d5 from the flat portion 105 to the rearmost end 104".

That is, the blowing device 100 according to the embodiment of the disclosure may allow the second blowing fan 102 to be arranged at a distance from the rear surface 10*b* of the main body 10 that is smaller than that in the case of having no flat portion 105 by a distance d5.

Accordingly, the amount of air flowing directly into the suction inlet 109 from the second region 112 is increased, and even when the second blowing fan 102 is driven with a small output, the amount of air flowing into the suction inlet 109 is increased, so that noise is reduced and the efficiency of the blowing device 100 may be increased.

As illustrated in FIG. 9, the length of a diameter d1 of the second blowing fan 102 based on the rotational axis X thereof may be provided approximately three times or more the length of the width d3 of the first region 111. This is because the efficiency of the blowing device 100 may deteriorate when the diameter d1 of the second blowing fan 102 is formed to be less than about three times the length of the width d3 of the first region 111.

In addition, a distance in the front-to-rear direction between the rotational axis X of the second blowing fan 102 and the rear surface 11*f* of the clothes care room 11 on the first region 111 may be provided in a range of about 145% to about 160% of the front-to-rear length of the width d3 of the second duct 110 on the first region 111.

When the distance in the front-to-rear direction between the rotation axis X of the second blowing fan 102 and the rear surface 11*f* of the clothes care room 11 on the first region 111 is formed in a length of about 145% or less of the width d3 of the first region 111, the distance d2 between the outer periphery of the second blowing fan 102 and the flat portion 105 inside the scroll 103 is significantly narrow and thus the air resistance inside the scroll 103 is increased.

Therefore, when the area of the flat portion 105 is enlarged to arrange the rotational axis X of the second blowing fan 102 excessively close to the rear surface 10*b* of the main body 10, the air resistance inside the scroll 103 is increased, and thus the efficiency of the blowing device 100 may decrease.

In addition, when the distance in the front-to-rear direction between the rotation axis X of the second blowing fan 102 and the rear surface 11*f* of the clothes care room 11 on the first region 111 is provided to be equal to or larger than about 160% of the length of the width d3 of the first region 111, the rotational axis X of the second blowing fan 102 is disposed at an excessively great distance in a forward direction from the rear surface 10*b* of the main body 10 so that the amount of airflow not affected by the suction airflow formed by the second blowing fan 102 increases, and the efficiency of the blowing device 100 may decrease.

The distance d6 in the upper-to-lower direction between the rotational axis X of the second blowing fan 102 and the upper end of the first region 111 is provided to be approximately equal to or smaller than about 170% of the length of the diameter d1 of the second blowing fan 102.

When the distance d6 in the upper-to-lower direction between the rotational axis X of the second blowing fan 102 and the upper end of the first region 111 is provided to be approximately larger than about 170% of the length of the diameter d1 of the second blowing fan 102, the length of the second region 112 may be increased, and accordingly, the speed of air passing through the second region 112 may be sufficiently lowered.

That is, when the length of the second region 112 is formed to be greater than or equal to a predetermined length, the speed of air passing through the second region 112 is reduced, and thus the force of air flowing in the traveling direction is reduced and a large amount of air may be affected by the suction airflow formed by the second blowing fan 102.

Therefore, in this case, the blowing device 100 may efficiently suck in air to the suction inlet 109 even when the scroll 103 does not include the flat portion 105. However, when the length of the second region 112 increases in the upper-to-lower direction as described above, the inclined portion 113 becomes longer, and the capacity of the clothes care room 11 may be reduced, which may cause the usability to decrease.

Therefore, the distance d6 in the upper-to-lower direction between the rotation axis X of the second blowing fan 102 and the upper end of the first region 111 may be formed to be equal to or smaller than about 170% of the length of the diameter d1 of the second blowing fan 102.

The distance d2 between the outer periphery of the second blowing fan 102 and the flat portion 105 may be provided to be about 10% of the distance of the diameter d1 of the second blowing fan 102.

When the distance d2 between the outer periphery of the second blowing fan 102 and the flat portion 105 may be provided to be smaller than about 10% of the distance of the diameter d1 of the second blowing fan 102, the flow of air inside the scroll 103 is limited, and the blowing efficiency of the blowing device 100 may be lowered.

Conversely, when the distance d2 between the outer periphery of the second blowing fan 102 and the flat portion 105 is approximately greater than about 10% of the distance of the diameter d1 of the second blowing fan 102, the second blowing fan 102 is caused to be disposed excessively distant forward from the rear surface 10*b* of the main body 10 so that the amount of airflow that is not affected by the suction airflow formed by the second blowing fan 102 is increased, and thus the efficiency of the blowing device 100 may deteriorate.

As is apparent from the above, the blower of the clothes care apparatus is disposed adjacent to a rear surface of the main body, so that air introduced from the duct formed on the rear surface of the main body is efficiently sucked into the blower, so that the blower efficiency can be enhanced while reducing noise.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A clothes care apparatus comprising:

a main body including a clothes care room formed therein;

a blower configured to form an airflow inside the clothes care room, and disposed between an upper part of the clothes care room and an upper part of the main body; and a duct configured to allow air inside the clothes care room to be introduced into the blower by the blower, and formed between a rear part of the main body and a rear part of the clothes care room, wherein the blower includes a blowing fan and a scroll to cover the blowing fan, and the scroll includes a flat portion formed to extend in a direction corresponding to an extension direction of the duct to guide the air into the blower, and formed to contact with a contact portion of a rear surface of the main body.

2. The clothes care apparatus of claim 1, wherein the flat portion is disposed to face the rear part of the main body.

3. The clothes care apparatus of claim 2, wherein the duct includes a first region having a constant cross section in an upper-to-lower direction, and a second region extending upward from an upper end of the first region and having a cross section that increases as being directed upward to reduce speed of air passing through.

4. The clothes care apparatus of claim 3, wherein the blowing fan has a diameter equal to or larger than about 300% of a front-to-rear width length of the first region.

5. The clothes care apparatus of claim 3, wherein a front-to-rear distance between a rotating axis of the blowing fan and the rear part of the clothes care room on the first region is provided in a range of about 145% to about 160% of a front-to-rear width length of the first region.

6. The clothes care apparatus of claim 3, wherein an upper-to-lower distance between a rotating axis of the blowing fan and the upper end of the first region is equal to or smaller than 170% of a diameter of the blowing fan.

7. The clothes care apparatus of claim 1, wherein the scroll includes a discharge outlet formed to allow the air to be discharged by the blowing fan, and the flat portion is disposed at a side opposite to the discharge outlet.

8. The clothes care apparatus of claim 7, wherein the scroll further includes a suction inlet formed to allow the air to be sucked into the scroll, wherein the suction inlet is formed to be open in a leftward direction and a rightward direction of the scroll, and the discharge outlet is formed to be open in a front side direction of the scroll.

9. The clothes care apparatus of claim 8, wherein the air introduced into the duct is caused to flow upward by the blower, and then through the suction inlet so that the air is introduced to a side part of the blower.

10. The clothes care apparatus of claim 1, wherein the air introduced into the duct is caused to flow toward the blower by the blower, to flow through the blower, to be discharged from the blower.

11. The clothes care apparatus of claim 1, further comprising an inclined portion disposed on an upper portion of the rear part of the clothes care room and obliquely formed in a front direction, and the second region is formed between the inclined portion and the rear part of the main body.

12. The clothes care apparatus of claim 11, wherein the inclined portion is inclined with respect to an extension direction of the first region in a range of about 45 degrees to about 90 degrees.

13. The clothes care apparatus of claim 1, wherein an outer periphery of the blowing fan is spaced apart from the flat portion at a distance of about 10% of a diameter of the blowing fan.

14. The clothes care apparatus of claim 1, wherein the blowing fan includes a centrifugal fan.

15. The clothes care apparatus of claim 1, wherein the blowing fan includes a Sirocco fan.

16. A clothes care apparatus comprising:

a main body including a clothes care room formed therein;

a blower configured to form an airflow inside the clothes care room, and disposed between an upper part of the clothes care room and an upper part of the main body; and a duct configured to allow air inside the clothes care room to be introduced into the blower by the blower, and formed between a rear part of the main body and a rear part of the clothes care room, wherein the blower includes a blowing fan and a scroll to cover the blowing fan, and the scroll includes a discharge outlet formed to allow air to be discharged forward, a flat portion arranged behind the scroll, formed to extend in a upper-to-lower direction to guide the air into the blower, and formed to contact with a contact portion of a rear surface of the main body, and a suction inlet formed to allow air to be sucked in and arranged at a lateral side of the scroll, wherein the air introduced into the duct is caused to flow upward along the duct by the blower, flow into a side part of the blower through the suction inlet, and then to be discharged forward.

17. The clothes care apparatus of claim 16, wherein the flat portion is arranged to face the rear part of the main body.

18. The clothes care apparatus of claim 16, wherein the flat portion is formed to extend collinear with the rear part of the main body in the upper-to-lower direction.

19. The clothes care apparatus of claim 16, wherein the flat portion is formed to extend in a direction corresponding to an extension direction of the duct.

20. A clothes care apparatus comprising:

a main body including a clothes care room formed therein;

a blower configured to form an airflow inside the clothes care room, and disposed between an upper part of the clothes care room and an upper part of the main body; and a duct configured to allow air inside the clothes care room to be introduced into the blower by the blower, and formed between a rear part of the main body and a rear part of the clothes care room, wherein the blower includes a blowing fan and a scroll to cover the blowing fan, and the scroll includes a flat portion formed to extend collinear with the rear part of the main body in an upper-to-lower direction to guide the air into the blower, and formed to contact with a contact portion of a rear surface of the main body.

* * * * *